US010131180B1

(12) United States Patent
Marotta

(10) Patent No.: US 10,131,180 B1
(45) Date of Patent: Nov. 20, 2018

(54) COLLAPSIBLE PAINT CADDY

(71) Applicant: Anthony J Marotta, New York, NY (US)

(72) Inventor: Anthony J Marotta, New York, NY (US)

( * ) Notice: Subject to any disclaimer, the term of this patent is extended or adjusted under 35 U.S.C. 154(b) by 86 days.

(21) Appl. No.: 15/285,435

(22) Filed: Oct. 4, 2016

Related U.S. Application Data

(60) Provisional application No. 62/248,836, filed on Oct. 30, 2015.

(51) Int. Cl.

| | |
|---|---|
| ***B44D 3/12*** | (2006.01) |
| ***B65D 21/08*** | (2006.01) |
| ***B65D 25/14*** | (2006.01) |
| ***B65D 25/28*** | (2006.01) |
| ***B65D 5/60*** | (2006.01) |
| ***B65D 33/01*** | (2006.01) |

(52) U.S. Cl.
CPC ..... *B44D 3/126* (2013.01); *B65D 5/60* (2013.01); *B65D 21/086* (2013.01); *B65D 25/14* (2013.01); *B65D 25/287* (2013.01); *B65D 33/01* (2013.01)

(58) Field of Classification Search
CPC ..... B44D 3/126; B65D 25/16; Y10S 229/908
USPC ..... 220/495.02
See application file for complete search history.

(56) References Cited

U.S. PATENT DOCUMENTS

| | | | | |
|---|---|---|---|---|
| 2,972,765 A | | 2/1961 | Macy | |
| 3,752,494 A | * | 8/1973 | Dunn | B44D 3/126 15/257.06 |
| 3,757,990 A | | 9/1973 | Buth | |
| 5,103,999 A | * | 4/1992 | Elliott | B44D 3/126 220/570 |
| 6,019,241 A | * | 2/2000 | Burns | B44D 3/126 15/257.06 |
| 6,679,398 B1 | | 1/2004 | O'Brien | |
| 8,690,048 B2 | | 4/2014 | Philips | |
| 9,434,512 B2 | * | 9/2016 | Branyon | B65D 33/06 |
| 2006/0213843 A1 | * | 9/2006 | Botner | A47L 23/20 211/34 |
| 2012/0006825 A1 | * | 1/2012 | Morla | B44D 3/126 220/495.02 |
| 2014/0197173 A1 | | 7/2014 | Morla | |
| 2015/0114968 A1 | | 4/2015 | Jolls | |

* cited by examiner

*Primary Examiner* — Shawn M Braden

(74) *Attorney, Agent, or Firm* — QuickPatents, LLC; Kevin Prince

(57) ABSTRACT

A container system for holding paint for use by a person while painting a surface with a paint roller or a paint brush includes a container comprised of five panels that fold from a relatively flat collapsed configuration into a container configuration that includes four side walls and a bottom wall. The top end of the container is open and exposes an internal volume that is sized to allow the paint brush and the paint roller through the open top end to access the internal volume. A flexible, liquid-impervious bag is open at one end thereof and adapted to fit within the internal volume of the container when the container is in the container configuration. The flexible bag may include a drain aperture in a bottom side thereof that is selectively sealable by an adhesive tape closure. A support brace and a detachable hand-carried mini-pail may be further included.

17 Claims, 7 Drawing Sheets

COLLAPSIBLE PAINT CADDY

CROSS-REFERENCE TO RELATED APPLICATIONS

This application claims the benefit of U.S. Provisional Patent Application 62/248,836, filed on Oct. 30, 2015, and incorporated herein by reference.

STATEMENT REGARDING FEDERALLY SPONSORED RESEARCH AND DEVELOPMENT

Not Applicable.

FIELD OF THE INVENTION

This invention relates to painting, and more particularly to a collapsible paint container.

DISCUSSION OF RELATED ART

Traditional one-gallon paint cans are notoriously cumbersome to use while painting a wall or other surface. A paint brush is easily dropped and completely submerged into the paint, particularly when precariously balanced on the rim of the open can while not in use. Such cans are too small in diameter to allow a typical paint roller to be inserted therein for the light application of paint to the roller. Wiping a brush or a vertically-submerged roller on the edge of the can inevitably causes paint to drip down the outside of the can and contact whatever surface supports the can.

Lighter and more even application of paint to both brushes and rollers can be achieved with a traditional paint tray that is wide enough for the insertion of the roller and the rolling of the roller therein. But such paint trays are often flimsy, easy to inadvertently spill and step into. Further, such trays are non-collapsible and take up a significant volume when stored or transported.

Therefore, there is a need for a device that conveniently contains a useful volume of paint and facilitates the application of the paint onto a paint brush or paint roller. Such a needed device would collapse into a relatively flat volume for storage and transport, and would further expand into a container configuration that is easy to move, support on a stairway or other flat surface, and has a low center of gravity when paint is contained therein for inhibiting spills. Such a needed device would be tall enough to inhibit accidently stepping into the paint with one's foot, and would further include removable plastic liners with selectively openable drains for recovering unused paint. The present invention accomplishes these objectives.

SUMMARY OF THE INVENTION

The present invention is a container system for holding paint for use by a person while painting a surface with a paint roller or a paint brush. A container is comprised of five panels that fold from a relatively flat collapsed configuration into a container configuration that includes four side walls and a bottom wall. The top end of the container is open and exposes an internal volume that is sized to allow the paint brush and the paint roller through the open end to access the internal volume. Two opposing side walls of the four side walls further each include a handle projecting away therefrom.

A flexible, liquid-impervious bag is open at one end and adapted to fit within the internal volume of the container when the container is in the container configuration. The flexible bag is fixable to an outer surface of each side wall. Preferably the flexible bag further includes a drain aperture in a bottom side thereof that is selectively sealable by a closure, such as a tab of liquid-impervious web material having a temporary adhesive on one side thereof.

In one embodiment, a collapsible, rigid support brace is further included that has a base member and a first side member pivotally fixed with one end of the base member. The support brace is wider than the container when in the container configuration and is adapted to engage the bottom wall of the container to support the container on a horizontal surface. The first side member contacts and supports one of the side walls of the container, and the support brace is positionable into a relatively flat collapsed configuration for storage and transport. The support brace further includes a second side member pivotally fixed with the one end of the base member and is positionable downwardly from the one end of the base member to support the container on a horizontal step below the horizontal surface, adding to the stability of the container when used on a staircase, for example.

In one embodiment, a collapsible mini-pail is included that is detachable from one of the side walls of the container at one or more hooks and is hand carried. A magnet may be further included on either the mini-pail or the container for temporary holding of the paint brush having a magnetically-attractive portion.

The present invention is a device that conveniently contains a useful volume of paint and facilitates the application of the paint onto a paint brush or paint roller. The present device collapses into a relatively flat volume for storage and transport, and expands into a container configuration that is easy to move and support on a stairway or other flat surface, and that has a low center of gravity when paint is contained therein for inhibiting spills. The present invention is tall enough to inhibit accidently stepping into the paint with one's foot, and further includes removable plastic liners with selectively openable drains for recovering unused paint. Other features and advantages of the present invention will become apparent from the following more detailed description, taken in conjunction with the accompanying drawings, which illustrate, by way of example, the principles of the invention.

DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
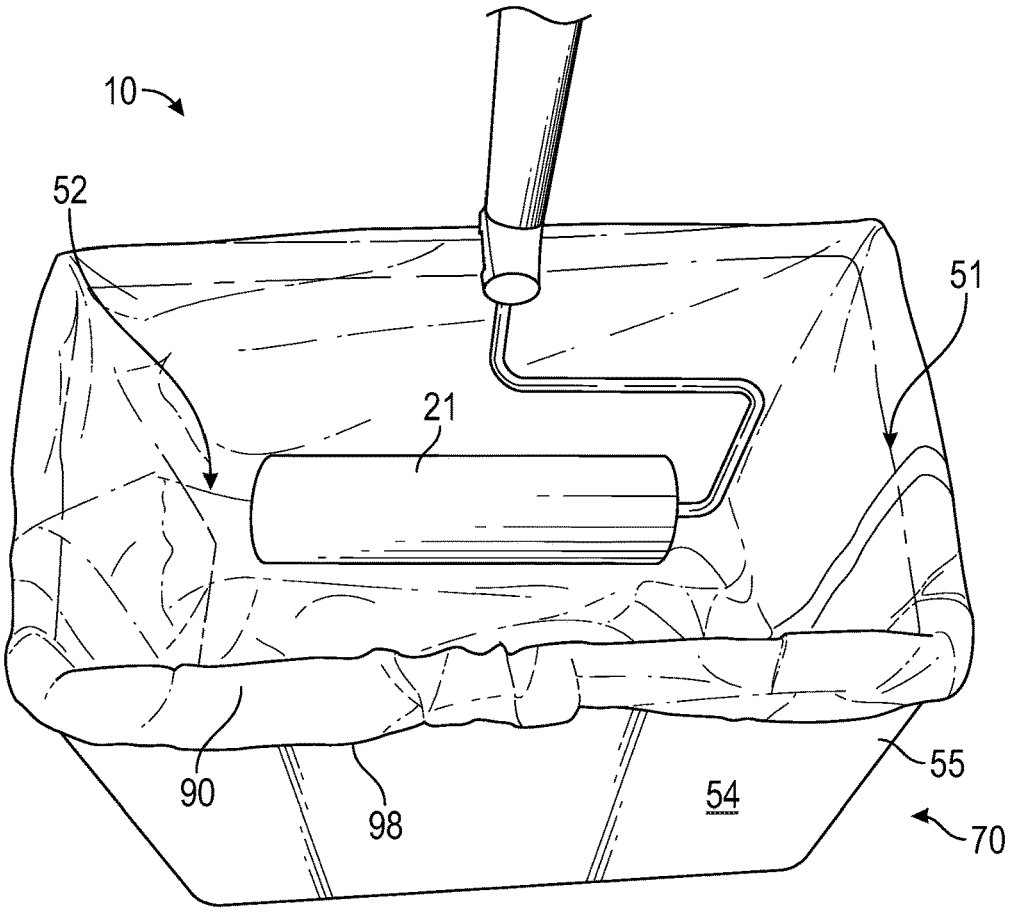
FIG. 1 is a perspective view of the invention, illustrated in a container configuration and with a paint roller.
Figure 2:
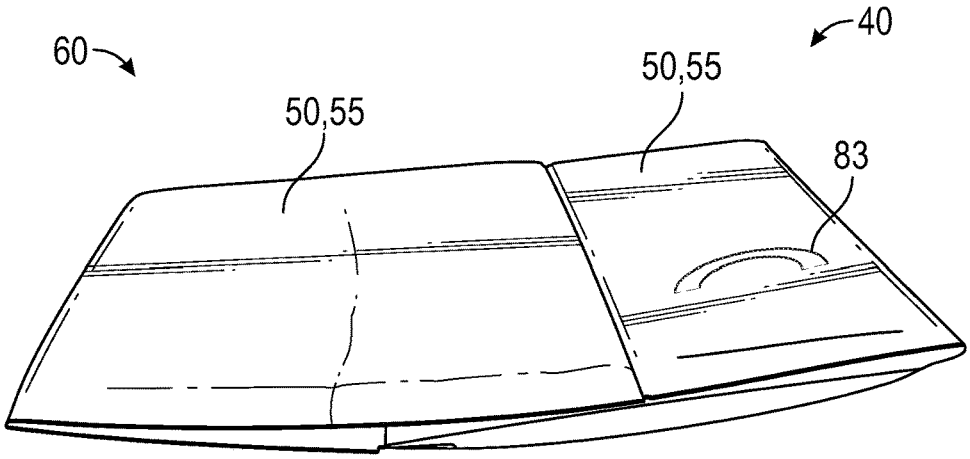
FIG. 2 is a perspective view thereof, illustrated in a collapsed configuration and with the paint roller omitted.

FIGS. 1 and 2 illustrate a container system 10 for holding paint 30 for use by a person 20 while painting a surface 15 with a paint roller 21 or a paint brush 22. A container 40 is comprised of five panels 50 that fold from a relatively flat collapsed configuration 60 (FIG. 2) into a container configuration 70 (FIGS. 1, 3, 5 and 6) that includes four side walls 55 and a bottom wall 59. The top end 51 of the container is open and exposes an internal volume 52 that is sized to allow the paint brush 22 and the paint roller 21 through the open top end 51 to access the internal volume 52 of the container 40. Preferably the container 40 is made from a plastic sheet material, a corrugated plastic sheet material, a corrugated fiberboard material, or the like.

Figure 10:
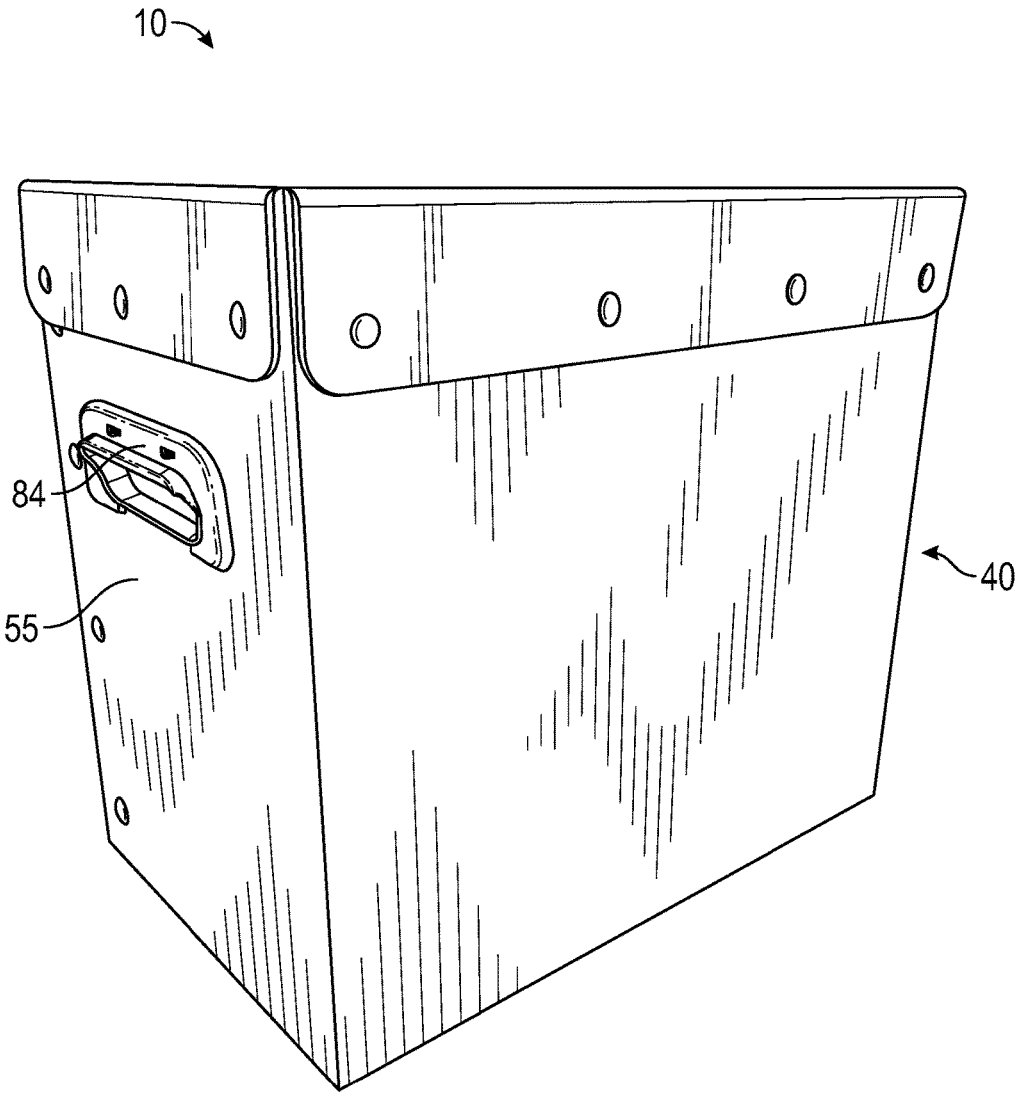
FIG. 10 is a perspective view of the invention showing an alternate injection-molded handle.

Two opposing side walls 55 of the four side walls 55 further each include a handle 80 (FIG. 7) projecting away therefrom. In one embodiment, each of the handles 80 is a length of rope 81 fixed at each end 82 thereof through one of the side walls 55 of the container 40. Alternately each handle 80 may be a die-cut handle 83 that pivots away from one of the side walls 55 of the container 40 (FIG. 2). Alternately, each handle 80 may be a molded plastic handle 84 (FIG. 10) that is fixed with one of the side walls 55 of the container 40.

Preferably the two opposing side walls 55 with the handles 80 are narrower, and thus are shorter in length, than the other two opposing side walls 55, whereby the open top end 51 forms a rectangle in plan view. As shown in FIG. 2, when in the collapsed configuration 60, the container 40 preferably collapses down to a footprint of no larger than the sum of the areas of two of the adjacent side walls 55 of the container 40.

Figure 9:
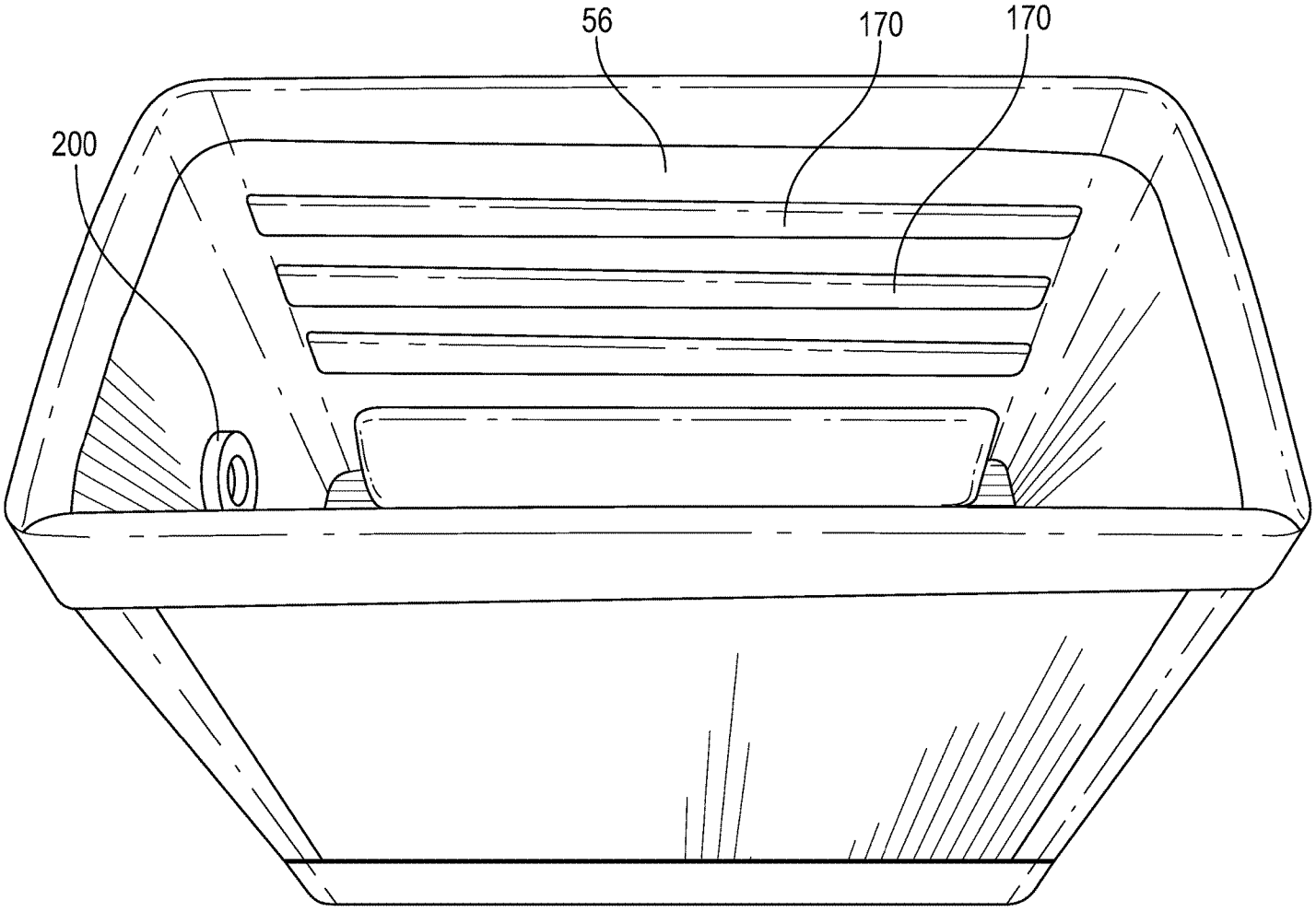
FIG. 9 is a top perspective view of one embodiment showing a plurality of ribs on an inside wall of the container.

A flexible, liquid-impervious bag 90, such as a flexible plastic bag, is open at one end 98 and adapted to fit within the internal volume 52 of the container 40 when the container 40 is in the container configuration 70. The flexible bag 90 is fixable to an outer surface 54 of each side wall 55 but not to the extent that the flexible bag 90 extends below the handles 80. An inside surface 56 of one of the side walls 55 preferably includes a plurality of ribs 170 for facilitating the loading of paint 30 into the paint roller 21 when rolled therealong through the flexible bag 90 (FIG. 9).

Figure 4:
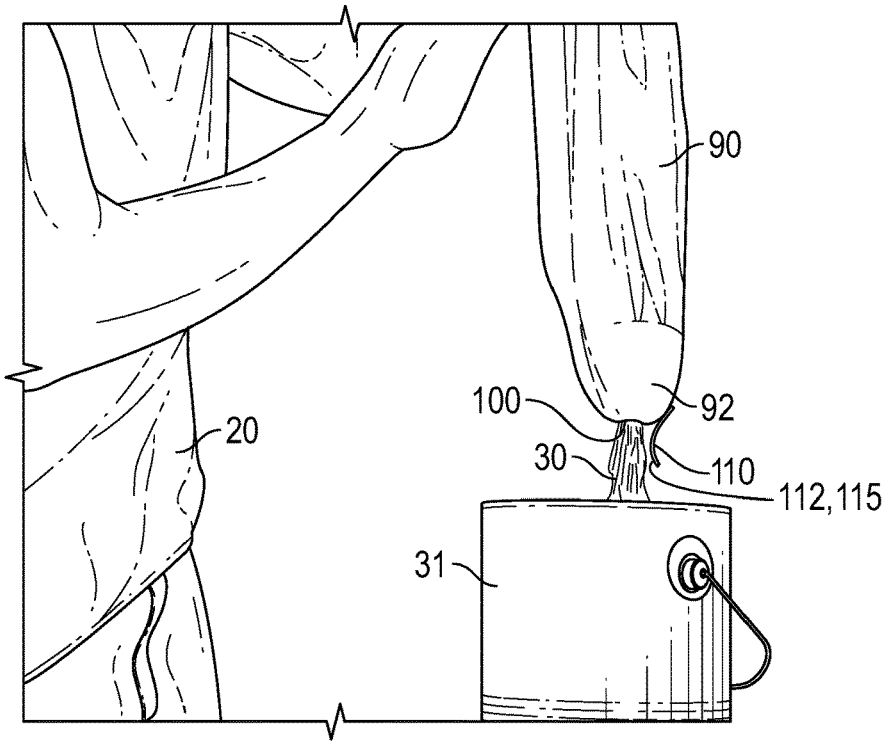
FIG. 4 is a side elevational view of a user draining excess paint out of a drain of a bag used as a liner for the container.
Figure 5:
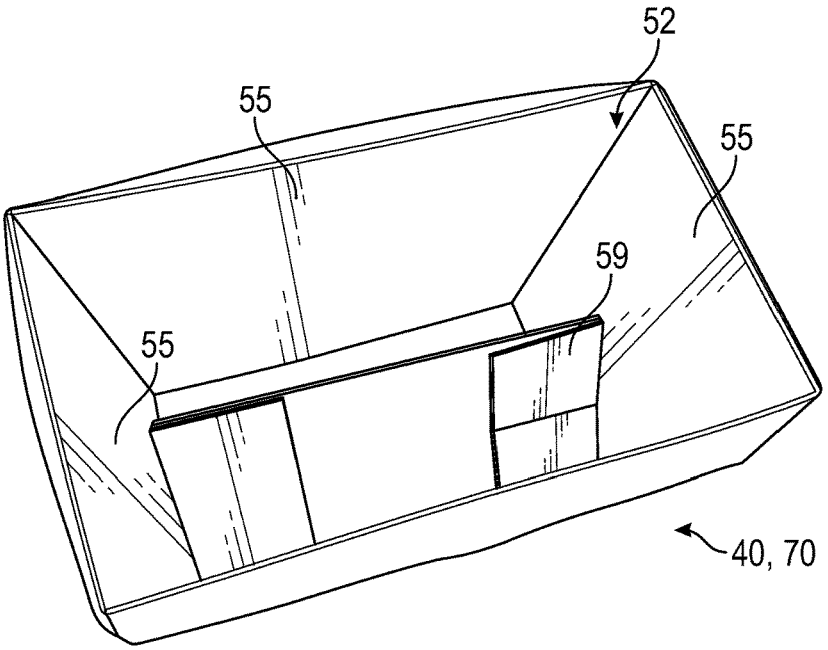
FIG. 5 is a top perspective view of a container as a bottom wall thereof is moved into place to configure the container into the container configuration.
Figure 6:
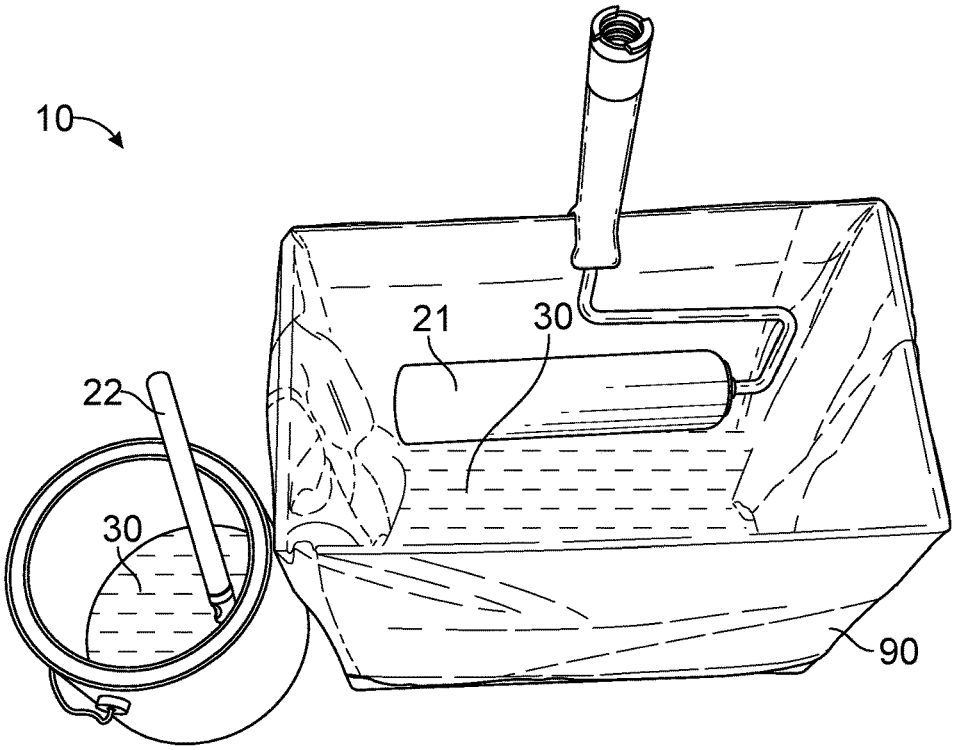
FIG. 6 is a top plan perspective view showing the bag lining the container and filled with paint, as during use.

Preferably the flexible bag 90 further includes a drain aperture 100 (FIG. 4) in a bottom side 92 thereof. The drain aperture 100 is selectively sealed by a closure 110, such as a tab of liquid-impervious web material having a temporary adhesive 115 on one side 112 thereof and that, when selectively applied over the drain aperture 100 seals the drain aperture 100. When the closure 110 is opened, unused paint 30 can be recovered into a paint can 31 or the like.

Figure 3:
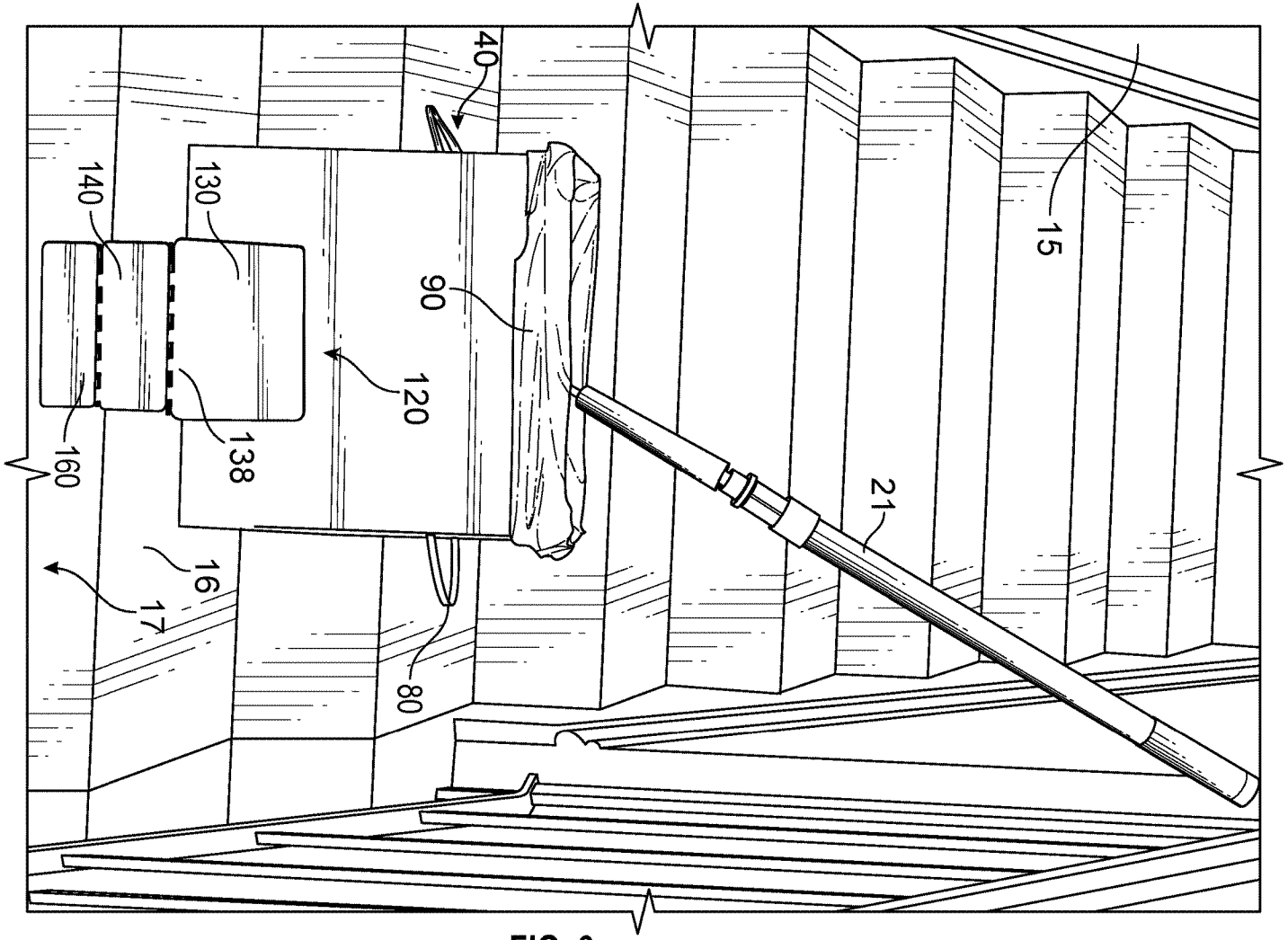
FIG. 3 is a perspective view of the invention in-use on a stairway, showing a support brace for maintaining the container upright.
Figure 7:
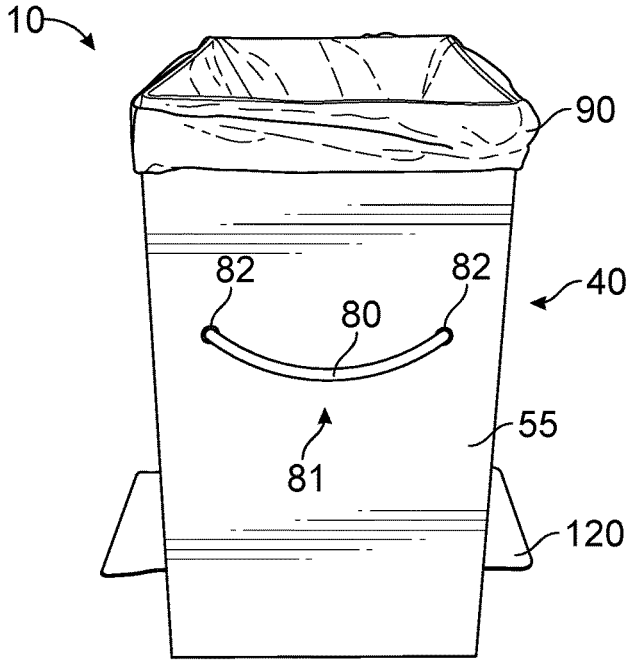
FIG. 7 is a side perspective view showing a handle projecting away from a side wall of the container.

In one embodiment, a collapsible, rigid support brace 120 is further included that has a base member 130 and a first side member 140 pivotally fixed with one end 138 of the base member 130. The support brace 120 is wider than the container 40 when in the container configuration 70 and is adapted to engage the bottom wall 59 of the container 40 to support the container 40 on a horizontal surface 16 (FIGS. 3 and 7). The first side member 140 contacts and supports one of the side walls 55 of the container 40, and the support brace 120 is positionable into a relatively flat collapsed configuration not shown) for storage and transport. The support brace 120 further includes a second side member 160 pivotally fixed with the first side member 140 and is positionable downwardly from the first side member 140 to support the container 40 on a horizontal step 17 below the horizontal surface 16 (FIG. 2), adding to the stability of the container 40 when used on a staircase, for example.

Figure 8:
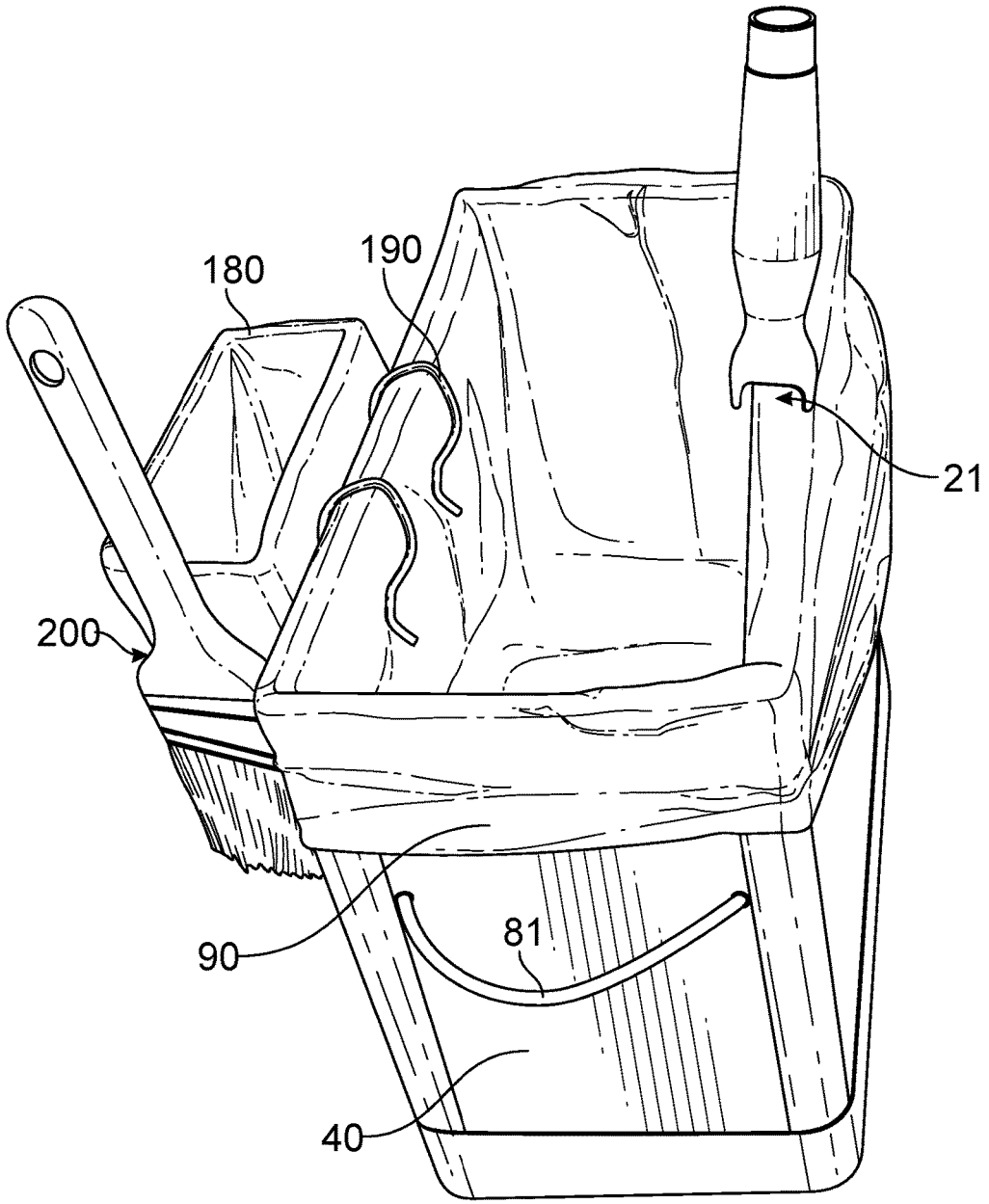
FIG. 8 is a perspective view of one embodiment showing a hand-carried container as affixed with one side of the container.

In one embodiment, a collapsible mini-pail 180 (FIG. 8) is included that is detachable from one of the side walls 55 of the container 40 at one or more hooks 190 and is hand carried. A magnet 200 may be further included on either the mini-pail 180 or the container 40 (FIG. 9) for temporary holding of the paint brush 22 having a magnetically-attractive portion.

While a particular form of the invention has been illustrated and described, it will be apparent that various modifications can be made without departing from the spirit and scope of the invention. For example, a particular shape of container 40 is shown in the figures, but other suitable shapes could be utilized as desired. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A container system for holding paint for use by a person while painting a paintable surface with a paint roller or paint brush, the container system comprising:

a container configured to fold from a relatively flat collapsed configuration into a container configuration, the container including a first side wall, a second side wall, a third side wall including a handle fixed thereto, a fourth side wall including a handle fixed thereto and a bottom wall; and a flexible, liquid-impervious bag having an open end and a closed end opposite of the open end;

wherein when the container is folded into the relatively flat collapsed configuration:

(a) at least the first and third side walls are contiguous and together define a first container layer, (b) at least the bottom wall defines a second container layer, (c) at least the second and fourth side walls are contiguous and together define a third container layer, and (d) the first, second and third container layers are layered adjacent to each other such that the second container layer is collapsed and folded inwardly within the container between the first and third container layers;

wherein when the container is folded into the container configuration:

(e) the bottom wall extends substantially horizontally and is configured to be supported by at least a support surface disposed beneath the bottom wall, (f) the first and second side walls extend vertically upward from the bottom wall and are spaced apart opposite of each other, (g) the third and fourth side walls extend vertically upward from the bottom wall and are spaced apart opposite of each other, (h) top edges of the first, second, third and fourth side walls define a top perimeter disposed above and spaced apart from the bottom wall, the top perimeter defining an open top end of the container, (i) an internal volume of the container is defined between the spaced apart first and second side walls, the spaced apart third and fourth side walls and the bottom wall, (j) the container is sized to allow the paint roller and the paint brush through the open top end to access the internal volume, (k) the flexible bag is adapted to fit within the internal volume of the container such that the open end of the flexible bag extends upwardly and around the open top end of the container and downwardly around outer surfaces of the first, second, third and fourth side walls while not covering the handles, (l) the open end of the flexible bag is fixable to the outer surfaces of the first, second, third and fourth side walls, (m) the flexible bag is configured to hold the paint within the container, and (n) the container is configured to be carried by the person grabbing the handles;

whereby with the container folded into the container configuration and the flexible bag fixed within the internal volume of the container and holding the paint, the person can dip the paint roller or paint brush into the paint in order to aid in the painting of the paintable surface.

2. The container system of claim 1 wherein the third and fourth side walls of the container are shorter in length than the first and second side walls of the container, whereby when the container is folded into the container configuration, the open top end of the container forms a rectangle in plan view.

3. The container system of claim 1 wherein a footprint of the container when folded into the relatively flat collapsed configuration is no larger than a sum of the areas of the first and third side walls of the container or a sum of the areas of the second and fourth side walls of the container.

4. The container system of claim 1 wherein a footprint of the container when folded into the relatively flat collapsed configuration is no larger than the area of the first container layer or the area of the third container layer of the container.

5. The container system of claim 1 wherein the handle fixed to the third side wall of the container is a length of rope having opposite ends thereof fixed to the third side wall and the handle fixed to the fourth side wall of the container is a length of rope having opposite ends thereof fixed to the fourth side wall.

6. The container system of claim 1 wherein the handle fixed to the third side wall of the container is a die-cut handle configured to pivot away from the third side wall and the handle fixed to the fourth side wall of the container is a die-cut handle configured to pivot away from the fourth side wall.

7. The container system of claim 1 wherein the container is made from a plastic sheet material.

8. The container system of claim 1 wherein the container is made from a corrugated plastic sheet material.

9. The container system of claim 1 wherein the container is made from a corrugated fiberboard material.

10. The container system of claim 1 wherein the flexible bag includes a drain aperture in the closed end thereof, the drain aperture selectively sealed by a removable closure, whereby unused paint may be selectively drained from the flexible bag through the drain aperture.

11. The container system of claim 10 wherein the removable closure is a tab of liquid-impervious web material having a temporary adhesive on one side thereof and that, when applied over the drain aperture seals the drain aperture.

12. The container system of claim 1 further comprising a collapsible rigid support brace including a base member and a first side member pivotally fixed with one end of the base member, the support surface disposed beneath the bottom wall of the container being a horizontal surface, and the support brace being wider than the container and adapted to engage the bottom wall of the container to support the container on the horizontal surface, the first side member contacting and supporting one of the first, second, third and fourth side walls of the container, the support brace being positionable into a relatively flat collapsed configuration.

13. The container system of claim 12 wherein the support brace further includes a second side member pivotally fixed with the one end of the base member and positionable downwardly from the one end of the base member to support the container on a horizontal step below the horizontal surface disposed beneath the bottom wall of the container.

14. The container system of claim 1 wherein an inner surface of one of the first, second, third and fourth side walls includes a plurality of ribs for facilitating the loading of paint into the paint roller when rolled on an inner surface of the flexible bag and along the plurality of ribs which contact an outer surface of the flexible bag opposite the inner surface of the flexible bag.

15. The container system of claim 1 wherein the handle fixed to the third side wall of the container is a molded plastic handle and the handle fixed to the fourth side wall of the container is a molded plastic handle.

16. The container system of claim 1 further comprising a collapsible mini-pail selectively detachable from one of the first, second, third and fourth side walls of the container, by way of one or more hooks, when the container is folded into the container configuration.

17. The container system of claim 16 further comprising a magnet included on either the mini-pail or the container for temporary holding of the paint brush by way of contact with a magnetically-attractive portion of the paint brush.

* * * * *